US011267497B2

(12) United States Patent
Zhuo et al.

(10) Patent No.: US 11,267,497 B2
(45) Date of Patent: Mar. 8, 2022

(54) METHOD AND APPARATUS FOR GENERATING MOVEMENT AUTHORITY FOR TRAIN, TRAIN-MOUNTED ATP AND ZC

(71) Applicant: BYD COMPANY LIMITED, Shenzhen (CN)

(72) Inventors: Kaikuo Zhuo, Shenzhen (CN); Qiongfang Wang, Shenzhen (CN); Faping Wang, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 333 days.

(21) Appl. No.: 16/474,248

(22) PCT Filed: Dec. 27, 2017

(86) PCT No.: PCT/CN2017/118909
§ 371 (c)(1),
(2) Date: Jun. 27, 2019

(87) PCT Pub. No.: WO2018/121583
PCT Pub. Date: Jul. 5, 2018

(65) Prior Publication Data

US 2020/0122759 A1 Apr. 23, 2020

(30) Foreign Application Priority Data

Dec. 27, 2016 (CN) ..... 201611224871.7

(51) Int. Cl.
*B61L 23/34* (2006.01)
*B61L 23/18* (2006.01)
(Continued)

(52) U.S. Cl.
CPC ..... *B61L 23/34* (2013.01); *B61L 23/18* (2013.01); *B61L 25/021* (2013.01);
(Continued)

(58) Field of Classification Search
CPC ..... B61L 23/00; B61L 23/18; B61L 23/34; B61L 25/021; B61L 25/025;
(Continued)

(56) References Cited

U.S. PATENT DOCUMENTS 9,828,011 B2 * 11/2017 Mongaya ..... B61L 23/34
11,067,995 B2 * 7/2021 Weiser ..... G06K 9/00791
(Continued)

FOREIGN PATENT DOCUMENTS

CA 293670 A1 8/2015
CN 101934807 A 1/2011
(Continued)

OTHER PUBLICATIONS

Susu Huang, et al., Analysis of ATP Safety Emergency Braking Model in Velocity Related Mode, Urban Rail Transit Research Apr. 2015, pp. 68-70, China.
(Continued)

*Primary Examiner* — Jason C Smith
(74) *Attorney, Agent, or Firm* — Anova Law Group, PLLC

(57) ABSTRACT

The present invention provides a method and apparatus for generating a movement authority for a train, an ATP and a ZC. The method comprises: acquiring a first distance between a first train and a second train; acquiring, according to the speed information of the second train, a response time required by the second train for running across the first distance; acquiring, according to the speed information of the first train, a second distance across which the first train runs within the response time; and generating a movement authority for the second train according to the first distance, the second distance and a preset safety margin. When the movement authority for the second train is calculated, the actual movement state of the first train is considered, and the
(Continued)

$$MA_1=S_1-D_1$$

$$MA_2=S_1+S_2-D_2$$

first train is no longer set as a stationary obstacle, so that the movement authority is prolonged, the tracking distance may be shortened, the operation efficiency of a line is improved, and the dispatching interval may be shortened to reduce the operation pressure at rush hours.

20 Claims, 5 Drawing Sheets

(51) Int. Cl.
*B61L 25/02* (2006.01)
*B61L 27/00* (2006.01)
*B61L 27/04* (2006.01)

(52) U.S. Cl.
CPC ..... *B61L 25/025* (2013.01); *B61L 27/0038* (2013.01); *B61L 27/0077* (2013.01); *B61L 27/04* (2013.01); *B61L 2201/00* (2013.01)

(58) Field of Classification Search
CPC .. B61L 27/0038; B61L 27/0077; B61L 27/04; B61L 2201/00
See application file for complete search history.

(56) References Cited

U.S. PATENT DOCUMENTS

| | | | | |
|---|---|---|---|---|
| 2015/0166085 | A1* | 6/2015 | Mongaya | B61L 23/34 246/2 S |
| 2018/0160333 | A1* | 6/2018 | Patil | H04L 67/12 |
| 2019/0337544 | A1* | 11/2019 | Chen | B61L 25/023 |
| 2019/0359237 | A1* | 11/2019 | Ouyang | B61L 25/025 |
| 2020/0122759 | A1* | 4/2020 | Zhuo | B61L 23/34 |

FOREIGN PATENT DOCUMENTS

| | | | | |
|---|---|---|---|---|
| CN | 102167066 | A | 8/2011 | |
| CN | 103029723 | A | 4/2013 | |
| CN | 103350709 | A | 10/2013 | |
| CN | 104260758 | A | 1/2015 | |
| CN | 105329264 | A | 2/2016 | |
| CN | 105501220 | A | 4/2016 | |
| KR | 101449742 | B1 | 10/2014 | |
| WO | WO-2018121583 | A1 * | 7/2018 | B61L 23/34 |

OTHER PUBLICATIONS

The World Intellectual Property Organization (WIPO) International Search Report and Written Opion for PCT/CN2017/118909 dated Mar. 23, 2018 13 Pages.

* cited by examiner $MA_1=S_1-D_1$ $MA_2=S_1+S_2-D_2$

METHOD AND APPARATUS FOR GENERATING MOVEMENT AUTHORITY FOR TRAIN, TRAIN-MOUNTED ATP AND ZC

CROSS-REFERENCE TO RELATED APPLICATIONS

This application is a national phase entry under 35 U.S.C. §371 of International Application No. PCT/CN2017/118909, filed on Dec. 27, 2017, which claims priority to Chinese Patent Application No. 201611224871.7, filed by BYD Company Limited on Dec. 27, 2016, content of all of which is incorporated herein by reference in its entirety.

FIELD

The present invention relates to the field of vehicle technology and, in particular to a method and apparatus for generating a movement authority for a train, a train-mounted ATP, and a ZC.

BACKGROUND

Currently, all trains registered to a zone controller (ZC) may report the real-time location information of the trains to the ZC. The ZC may calculate a movement authority for a following train, i.e., a rear train, according to the location information reported by the front train. Currently, the ZC calculates the movement authority for the rear train based on the absolute location of the train. In the process of calculating the movement authority, the ZC assumes that the front train is a stationary obstacle. When it is assumed that the front train is a stationary obstacle, the location of the front train becomes a fixed location, and is an absolute location relative to the location of the rear train. In this way, the movement authority for the rear train may be obtained by subtracting a safety margin from the absolute distance between the two trains.

In fact, in most cases, the front train is also running at a high speed, and is stationary only at stations. When an automatic train protection (ATP) curve is calculated using the movement authority obtained according to the prior art, the minimum tracking interval obtained is larger than the permissible tracking interval when the front and rear trains are actually running. In order to ensure safety operation of the trains, the minimum tracking interval of the front and rear trains cannot exceed an emergency braking distance of the rear train. Otherwise, emergency braking is triggered, so that the tracking interval between the trains may not be shortened according to the actual operation during the peak period of trains, and the operation efficiency of a line is low.

SUMMARY

An objective of the present invention is to at least resolve one of the technical problems in the related art to some extent.

To this end, an objective of the present invention is to provide a method for generating a movement authority for a train, which may consider the actual movement state of a front train when a movement authority for a rear train is calculated, and no longer sets the front train as a stationary obstacle, so that the movement authority is prolonged, the tracking distance may be shortened, and the operation efficiency of a line is improved.

Another objective of the present invention is to provide an apparatus for generating a movement authority for a train.

Another objective of the present invention is to provide a train-mounted ATP.

Another objective of the present invention is to provide a ZC.

In order to achieve the above objectives, a method for generating a movement authority for a train according to an embodiment of a first aspect of the present invention comprises:

acquiring a first distance between a first train and a second train; wherein the first train is in front of the second train and closest to the second train;

acquiring, according to the speed information of the second train, a response time required by the second train for running across the first distance;

acquiring, according to the speed information of the first train, a second distance across which the first train runs within the response time; and generating a movement authority for the second train according to the first distance, the second distance and a preset safety margin.

According to the method for generating a movement authority for a train, provided by the embodiment of the first aspect of the present invention, the actual movement state of a front train is considered when a movement authority for a rear train is calculated, and the front train is no longer set as a stationary obstacle, so that the movement authority is prolonged, the tracking distance may be shortened, and the operation efficiency of a line is improved.

In order to achieve the above objective, an apparatus for generating a movement authority for a train according to an embodiment of a second aspect of the present invention comprises:

a first acquisition module, configured to acquire a first distance between a first train and a second train; wherein the first train is in front of the second train and closest to the second train;

a second acquisition module, configured to acquire, according to the speed information of the second train, a response time required by the second train for running across the first distance;

a third acquisition module, configured to acquire, according to the speed information of the first train, a second distance across which the first train runs within the response time; and a generation module, configured to generate a movement authority for the second train according to the first distance, the second distance and a preset safety margin.

According to the apparatus for generating a movement authority for a train, provided by the embodiment of the second aspect of the present invention, the actual movement state of a front train is considered when a movement authority for a rear train is calculated, and the front train is no longer set as a stationary obstacle, so that the movement authority is prolonged, the tracking distance may be shortened, and the operation efficiency of a line is improved.

In order to achieve the above objectives, a train-mounted ATP according to an embodiment of a third aspect of the present invention comprises:

the apparatus for generating a movement authority for a train according to the embodiment of the second aspect of the present invention.

In order to achieve the above objectives, a ZC according to an embodiment of a fourth aspect of the present invention comprises:

the apparatus for generating a movement authority for a train according to the embodiment of the second aspect of the present invention.

The additional aspects and advantages of the present invention will be provided in the following description, and some of the additional aspects and advantages will become clear in the following description or be understood through practice of the present invention.

BRIEF DESCRIPTION OF THE DRAWINGS

These and other aspects and advantages of embodiments of the present invention will become apparent and more readily appreciated from the following descriptions made with reference to the drawings, in which.

DETAILED DESCRIPTION

The following describes in detail embodiments of the present invention. Examples of the embodiments are shown in the accompanying drawings, where reference signs that are the same or similar represent same or similar modules or modules that have same or similar functions. The following embodiments described with reference to the accompanying drawings are exemplary, and are merely intended to describe the present invention and cannot be construed as a limitation to the present invention. Conversely, the embodiments of the present invention cover all variations, modifications and equivalents within the spirit and scope of the appended claims.

Figure 1:
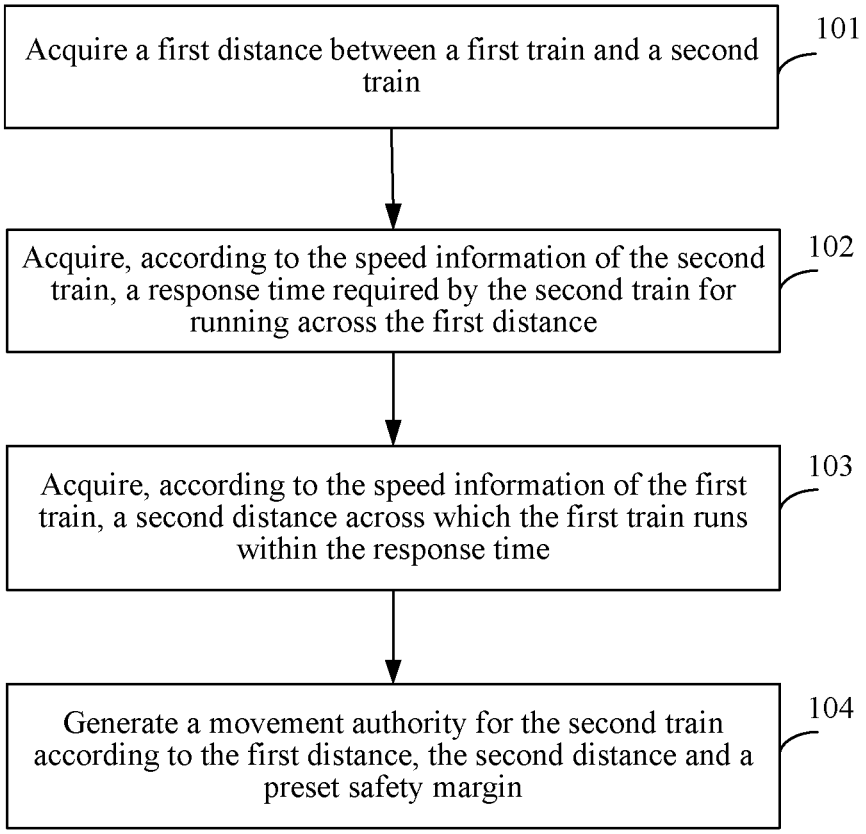
FIG. 1 is a process diagram of a method for generating a movement authority according to an embodiment of the present invention.

FIG. 1 is a process diagram of a method for generating a movement authority for a train according to an embodiment of the present invention. In this embodiment, the executing entity of the method for generating a movement authority for a train is a train-mounted ATP on a second train. As shown in FIG. 1, the method for generating a movement authority for a train comprises the following steps:

S101, a first distance between a first train and a second train is acquired.

The first train is in front of the second train and closest to the second train.

Specifically, the train-mounted ATP may acquire a first distance between the first train and the second train according to the location information of the first train and the location information of the second train. Preferably, the train-mounted ATP may receive a message from a ZC, and the ZC may receive location information reported by all registered trains. The train-mounted ATP may receive the location information of all the registered trains, which is sent by the zone controller. In order to determine the locational relationship between the trains, the train-mounted ATP may sort the locations of all the registered trains according to the location information received from the ZC. After sorting, the train-mounted ATP may determine the first train corresponding to the second train according to the sorting result.

Specifically, in order to reduce the computing load of the train-mounted ATP, the ZC may sort, after receiving the location information reported by all the registered trains, the reported location information, and send the sorting result to the train-mounted ATP. The train-mounted ATP receives the sorting result, and determines the first train corresponding to the second train therefrom.

After the first train corresponding to the second train is determined, the first distance between the first and second trains may be acquired according to the location information of the first and second trains.

S102, a response time required by the second train for running across the first distance is acquired according to the speed information of the second train.

In this embodiment, after acquiring the first distance, the train-mounted ATP may acquire speed information of the second train from a sensor mounted in the second train, and then acquire a response time required by the second train for running across the first distance according to the speed information of the second train, i.e., a response time required when the second train runs from the current location to the current location of the first train. The speed information of the second train comprises at least the running speed of the second train.

S103, a second distance across which the first train runs within the response time is acquired according to the speed information of the first train.

Specifically, during the tracking process, the first train and the second train may communicate with each other, and the first train may send the speed information of the first train to the train-mounted ATP of the second train. The speed information of the first train comprises at least the running speed of the first train. Further, a second distance across which the first train runs within the response time may be calculated according to the speed information of the first train.

S104, a movement authority for the second train is generated according to the first distance, the second distance and a preset safety margin.

Specifically, the train-mounted ATP adds the first distance to the second distance, and subtracts a preset safety margin from the added result to obtain a movement authority for the second train. In this embodiment, because the second train may directly communicate with the first train, the first train sends speed information of the first train, safety envelopes and the like to the second train directly without transit of the ZC, which can improve the accuracy of locations of the first and second trains. Moreover, in the embodiment, the second train calculates the movement authority through the train-mounted ATP itself, which saves the communication time required in the prior art for calculating a movement authority and then transmitting the same to the second train by a ZC. The first and second trains may communicate with each other directly, and the process of transmitting the movement authority by the ZC is avoided, so that the communication delay time is reduced, and when the movement authority for the second train is calculated and the safety margin is preset in this embodiment, the above content may be considered to appropriately reduce the safety margin.

Figure 2:
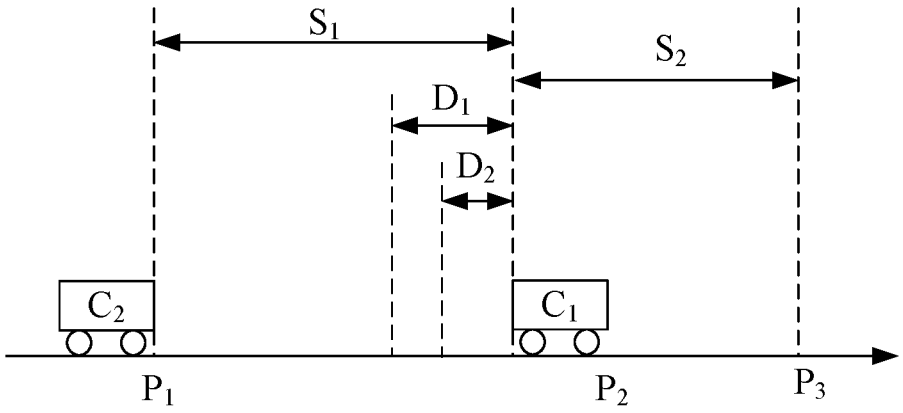
FIG. 2 is an application diagram of a method for generating a movement authority according to an embodiment of the present invention.

FIG. 2 is an application diagram of a method for generating a movement authority according to an embodiment of the present invention. As shown in FIG. 2, two trains are marked in the figure, respectively $C_1$ and $C_2$, where $C_1$ is the first train, and $C_2$ is the second train. Three location points $P_1$, $P_2$ and $P_3$ are marked in FIG. 2, where $P_1$ is the current location of the second train $C_2$, $P_2$ is the current location of the first train $C_1$, and $P_3$ is a location arrived at by the first train $C_1$ when the second train $C_2$ runs from $P_1$ to $P_2$. The distance between $P_1$ and $P_2$ is the first distance between the first train and the second train, marked as $S_1$; the distance between $P_2$ and $P_3$ is the second distance across which the first train $C_1$ runs within the time when the second train $C_2$ runs from $P_1$ to $P_2$, marked as $S_2$.

In the conventional method for generating a movement authority, the movement authority is $MA_1=S_1-D_1$. In the method for generating a movement authority according to this embodiment, the movement authority is $MA_2=S_1+S_2-D_2$. $D_1$ is a preset safety margin in the prior art, and $D_2$ is a preset safety margin in this embodiment. In this embodiment, because the communication delay time is reduced, when the movement authority for the second train is calculated and the safety margin is preset, the above content may be considered to appropriately reduce the safety margin, that is, the preset safety margin $D_2$ may be smaller than $D_1$. It may be seen from FIG. 2 that the movement authority calculated in this embodiment is prolonged.

According to the method for generating a movement authority for a train, provided by this embodiment, a first distance between a first train and a second train is acquired, a response time required by the second train for running across the first distance is acquired according to the speed information of the second train, a second distance across which the first train runs within the response time is acquired according to the speed information of the first train, and a movement authority for the second train is generated according to the first distance, the second distance and a preset safety margin. In this embodiment, when the movement authority for the second train is calculated, the actual movement state of the first train is considered, and the first train is no longer set as a stationary obstacle, so that the movement authority is prolonged, the tracking distance may be shortened, the operation efficiency of a line is improved, and the dispatching interval may be shortened to reduce the operation pressure at rush hours.

Figure 3:
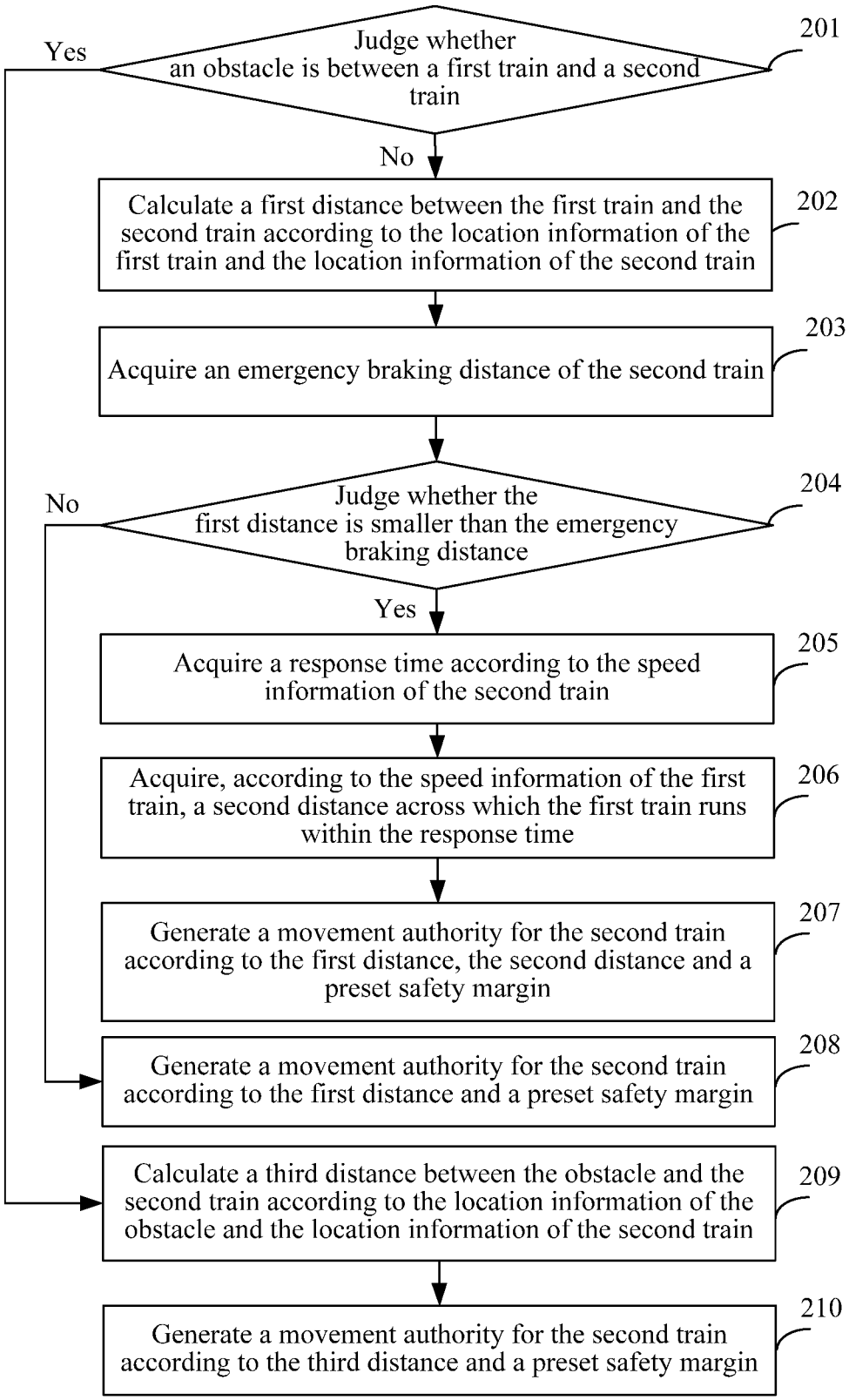
FIG. 3 is a process diagram of another method for generating a movement authority according to an embodiment of the present invention.

FIG. 3 is a process diagram of another method for generating a movement authority for a train according to an embodiment of the present invention. In this embodiment, the executing entity of the method for generating a movement authority for a train is a train-mounted ATP on a second train. As shown in FIG. 3, the method for generating a movement authority for a train comprises the following steps:

S201, whether an obstacle is between a first train and a second train is judged.

After receiving a message fed back by a ZC, the train-mounted ATP may acquire a first train corresponding to a second train. For the specific process, reference may be made to the description of related content in the foregoing embodiment, and details are not described herein again.

In order to ensure the driving safety, the train-mounted ATP may detect whether an obstacle is on a road ahead through a radar apparatus. In this embodiment, the train-mounted ATP may judge whether an obstacle is between the first train and the second train. If there is no obstacle, S202 is executed; if there is an obstacle, S209 is executed.

S202, a first distance between the first train and the second train is calculated according to the location information of the first train and the location information of the second train.

Specifically, the train-mounted ATP may acquire a first distance between the first train and the second train according to the location information of the first train and the location information of the second train. For the specific process, reference may be made to the description of related content in the foregoing embodiment, and details are not described herein again.

S203, an emergency braking distance of the second train is acquired.

In practical applications, the tracking distance between the first and second trains is greater than the emergency braking distance of the second train, so as to avoid a traffic accident that the second train collides with the first train when the second train tracks the first train. In this embodiment, the specific process that the train-mounted ATP acquires an emergency braking distance of the second train is as follows:

$V_{m1}$ is a train design speed of the second train; $a_{e1}$ is a maximum deceleration during emergency braking; $t_{11}$, $t_{21}$ and $t_{31}$ are respectively three time periods of out-of-control acceleration, idling and braking establishment in a safety braking model; $S_{e1}$ is an emergency braking distance of the second train at the maximum permissible speed under the most unfavorable condition. The initial speed is assumed to be the train design speed $V_{m1}$, the speed is still $V_{m1}$ in the out-of-control acceleration and idling phases, the speed is uniform deceleration in the braking establishment phase, and the deceleration is $a_{e1}/2$.

The simplified calculation formula of $S_{e1}$ is as follows:

After braking establishment, the speed is:

$$V_{31}=V_{m1}+(a_{e1}/2)*t_{31}$$

The braking establishment process is simplified to a uniform motion, and the running distance of the braking establishment process is:

$$S_{31}=((V_{m1}+V_{31}))/2*t_{31}$$

Then, the emergency braking distance of the second train is:

$$S_{e1}=V_{m1}*(t_{11}+t_{21})+S_{31}+(0-V_{31}^2)/2*a_{e1}$$

According to the above formula, in one embodiment, the ATP may calculate the emergency braking distance of the second train according to the design speed of the second train.

S204, whether the first distance is smaller than the emergency braking distance is judged.

After acquiring the emergency braking distance of the second train, the train-mounted ATP may compare the first distance with the emergency braking distance to judge whether the first distance is smaller than the emergency braking distance. If the judgment result is that the first distance is smaller than the emergency braking distance, S205 is executed; if the judgment result is that the first distance is equal to or greater than the emergency braking distance, S208 is executed.

S205, a response time is acquired according to the speed information of the second train.

When the first distance is smaller than the emergency braking distance, it may be determined that the distance between the first and second trains is short. If the first train is set as a stationary state according to the conventional method for generating a movement authority for a train to calculate the movement authority, when an ATP curve is calculated according to the movement authority, it is often determined that emergency braking is required for the second train to avoid the risk of collision with the first train. In the actual situation, the first train is also running at a high speed. In this case, even if emergency braking is not performed on the second train, the second train does not collide with the first train. In this embodiment, in order to avoid the problem in the prior art that emergency braking for the second train is easily caused by setting the first train in a stationary state when the movement authority is calculated, the train-mounted ATP further acquires, when judging that the first distance is smaller than the emergency braking distance, a response time required by the second train for running across the first distance according to the speed information of the second train.

Specifically, within the distance $S_1$ from the second train to the rear end of the first train, if the strictest speed limit value of the second train is $V_{mr}$, the response time is $t=S_1/V_{mr}$; in the presence of a plurality of different strict speed limit values, segmented calculation is required for time and then the time is accumulated, that is, $t=S_a/V_{mra}+S_b/V_{mrb}+\ldots Sn/V_{mrn}$; wherein $S_1=S_a+S_b+\ldots S_n$.

S206, a second distance across which the first train runs within the response time is acquired according to the speed information of the first train.

Figure 4:
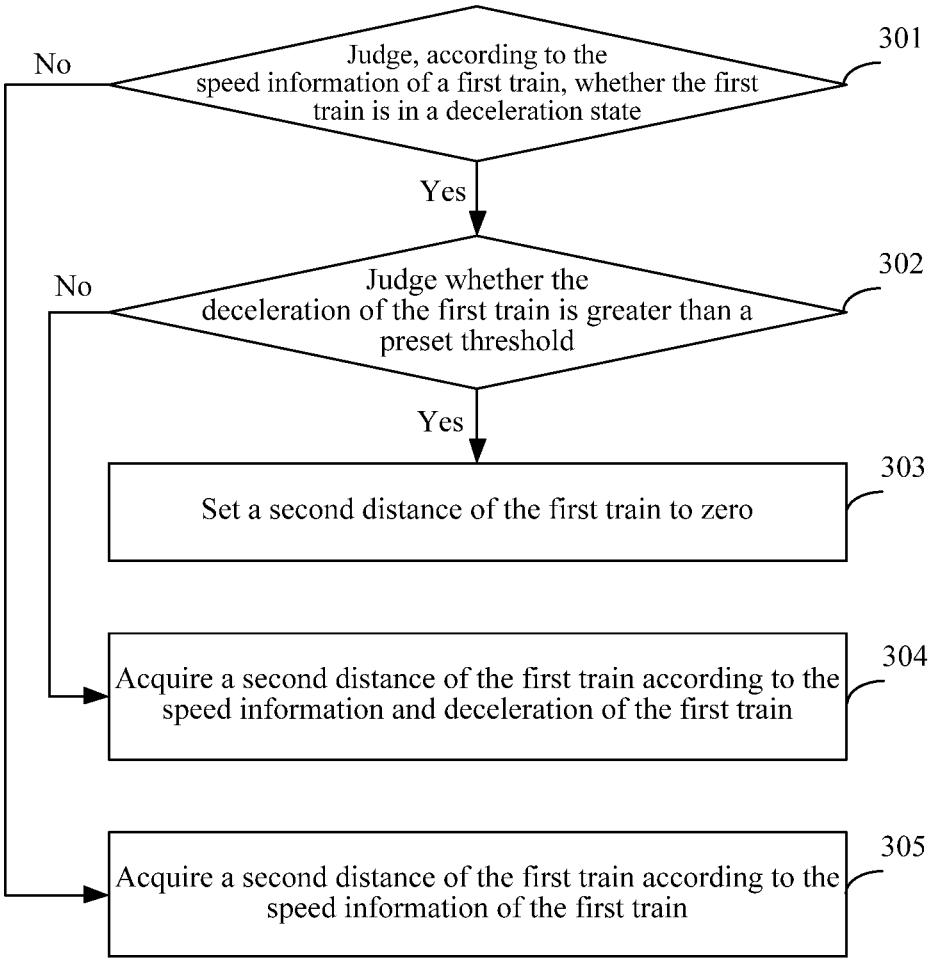
FIG. 4 is a process diagram of acquiring a second distance across which the first train runs within the response time according to an embodiment of the present invention.

FIG. 4 is a process diagram of acquiring a second distance across which the first train runs within the response time according to an embodiment of the present invention. In order to ensure the driving safety, the train-mounted ATP may also identify the movement state of the first train before determining the second distance, that is, identify whether the first train is in an accelerated driving state, a uniform driving state, or a decelerated driving state. The specific process is as shown in FIG. 4.

S301, whether a first train is in a deceleration state is judged according to the speed information of the first train.

Specifically, the train-mounted ATP may compare the speed information of the first train received currently with the speed information of the first train received last time to acquire an acceleration of the first train. Whether the first train is in a deceleration state is judged according to the acceleration. If the acceleration is negative, the first train is in a deceleration state; if the acceleration is positive, the first train is in an acceleration state; and if the acceleration is 0, the first train is in a constant speed state.

If it is judged that the first train is in a deceleration state, S302 is executed; if it is judged that the first train is in an acceleration state or a constant speed state, S305 is executed.

S302, whether the deceleration of the first train is greater than a preset threshold is judged.

In this embodiment, a threshold is preset, and the threshold may be determined according to specific parameters of the first train and actual measured data. When it is judged that the first train is in a deceleration state, the acceleration of the first train acquired in S301 is the deceleration of the first train. In order to ensure the driving safety, the train-mounted ATP needs to compare the deceleration of the first train with the preset threshold to judge whether the deceleration of the first train is greater than the preset threshold. If the deceleration of the first train is equal to or greater than the preset threshold, it indicates that the first train is decelerating rapidly, and in order to ensure that the second train does not collide with the first train, S303 is executed. If the deceleration of the first train is smaller than the preset threshold, it indicates that the first train is decelerating normally, S304 is executed.

S303, a second distance of the first train is set to zero.

S304, a second distance of the first train is acquired according to the speed information and deceleration of the first train.

S305, a second distance of the first train is acquired according to the speed information of the first train.

In this embodiment, when the second distance across which the first train runs within the response time is acquired, the second distance of the first train is acquired according to the actual running state of the first train. Since the first train is in an acceleration state, which is a safe running state for the second train, an accident generally does not occur between the first and second trains. At this time, the second distance of the first train is acquired according to the actual running speed, acceleration and response time of the first train. When the first train is in a constant speed state, the second distance of the first train may be acquired according to the actual running speed and response time of the first train. In this embodiment, when it is judged that the train is in an acceleration state or a constant speed state, $S_2=V_2*t$ in a simplified way, where $S_2$ is the second distance, $V_2$ is the running speed of the first train, and t is the response time. When the first train is in a normal deceleration state, the second distance of the first train may be acquired according to the actual running speed, deceleration and response time of the first train. When the deceleration $a_2$ is relatively small, that is, when the first train is in normal deceleration, $S_2=V_2*t+a_2*t^2/2$, where $a_2$ is the current deceleration of the first train. When the first train is in a rapid deceleration state, if the distance across which the first train runs within the response time is continuously considered in the calculation process, the movement authority may be prolonged, correspondingly, the second train continues to reduce the tracking distance between the two trains and continues to track the first train, but the first train has stopped, so a collision occurs. In order to avoid the occurrence of collision, in this embodiment, when the first train is in a rapid deceleration state, the second distance is set to zero to reduce the risk of collision between the two trains. In this embodiment, when the second distance of the first train is acquired, reference is further made to the movement state of the first train, thereby improving the accuracy of the movement authority and improving the driving safety.

S207, a movement authority for the second train is acquired according to the first distance, the second distance and a preset safety margin.

Specifically, the train-mounted ATP adds the first distance to the second distance, and subtracts a preset safety margin from the added result to obtain a movement authority. In this embodiment, the first and second trains may communicate with each other directly, and the process of transmitting the movement authority by the ZC is avoided, so that the communication delay time is reduced, and when the movement authority for the second train is calculated and the safety margin is preset in this embodiment, the above content may be considered to appropriately reduce the safety margin.

S208, a movement authority for the second train is generated according to the first distance and a preset safety margin.

When the first distance is greater than the emergency braking distance, it may be determined that the distance between the first and second trains is long, and generally, during emergency braking for the second train, the second train does not collide with the first train. The train-mounted ATP may subtract a preset safety margin from the first distance to obtain a movement authority for the second train.

S209, a third distance between the obstacle and the second train is calculated according to the location information of the obstacle and the location information of the second train.

S210, a movement authority for the second train is generated according to the third distance and a preset safety margin.

Specifically, the train-mounted ATP subtracts a preset safety margin from the third distance to obtain a movement authority for the second train.

In order to better understand the method for acquiring a movement authority for a train according to the embodiment of the present invention, for the advantages compared with the conventional method for acquiring a movement authority, the following describes an example:

It is set that the first distance $S_1$ between the first and second trains is 200 m, no obstacle point is between the first and second trains, the train radar does not sense an obstacle, and the parameters of the first and second trains are identical, as follows:

The maximum permissible speed, i.e., design speed $V_{m1}$ of the train is 3000 cm/s;

The first and second trains are in a uniform movement state, and the current speed is $V_1=V_2=2000$ cm/s;

The strictest speed limit of the entire first distance $S_1$ from the second train to the first train is also 2000 cm/s;

The maximum emergency braking deceleration $a_e$ is −100 cm/s2;

The maximum acceleration $a_m$ is 100 cm/s2;

The preset safety margin d is 5 m;

The parameter of the safety braking model is $t_1=t_2=t_3=1$s;

In the conventional method for acquiring a movement authority for a train, the movement authority for the second train is $S_1-d=195$ m; an ATP curve is calculated according to the movement authority length 195 m, an emergency braking trigger speed about 1940 cm/s may be obtained, and at this time, the current speed of the second train has exceeded the emergency braking trigger speed, so the second train has applied emergency braking. When the speed of the train is 2000 cm/s, the tracking distance of the second train is bound to be more than 200 m.

According to the method for acquiring a movement authority for a train provided by this embodiment, when no obstacle point is between the first and second trains, the emergency braking distance $S_{e1}$ of the second train at the maximum permissible speed under the most unfavorable condition is calculated first as follows:

$$V_{31}=V_{m1}+(a_{e1}/2)*t_{31}=3000+(-100/2)*1=2950 \text{ cm/s};$$

$$S_{31}=((V_{m1}+V_{31}))/2*t_{31}=(3000+2950)/2*1=2975 \text{ cm};$$

$$S_{e1}=V_{m1}*(t_{11}+t_{21})+S_{31}+(0-V_{31}^2)/2*a_{e1}=3000*2+2975+(0-2950*2950)/2*(-100)=52487.5 \text{ cm}\approx 525 \text{ m}.$$

It may be known from the above that when the first distance $S_1$ between the first and second trains is smaller than the emergency braking distance $S_{e1}$, i.e., 200 m<525 m, the time for the second train to run to the rear end of the first train is t=200/2000=0.1 s by estimation. At this time, the distance across which the first train runs within 0.1 s is $S_2=2000*0.1=200$ m, and the movement authority for the second train is $S1+S_2-d=395$ m.

When the ATP curve is calculated according to the movement authority of 395 m, the emergency braking trigger speed may be 2775 cm/s. Because the current speed of the second train is 2000 cm/s, which is smaller than the emergency braking trigger speed, the second train may also accelerate to reduce the tracking distance. According to the test, when the current first distance between the first and second trains is about 105 m, the emergency braking trigger speed of the second train is close to the current speed 2000 cm/s of the second train, so when the speed is 2000 cm/s, the movement authority obtained in this embodiment is longer than the movement authority obtained in the prior art, and the tracking distance between the first and second trains is obviously reduced, thereby improving the operation efficiency of a line.

According to the method for generating a movement authority for a train, provided by this embodiment, a first distance between a first train and a second train is acquired, a response time required by the second train for running across the first distance is acquired according to the speed information of the second train, a second distance across which the first train runs within the response time is acquired according to the speed information of the first train, and a movement authority for the second train is acquired according to the first distance, the second distance and a preset safety margin. In this embodiment, when the movement authority for the second train is calculated, the actual movement state of the first train is considered, and the first train is no longer set as a stationary obstacle, so that the movement authority is prolonged, the tracking distance may be shortened, the operation efficiency of a line is improved, and the dispatching interval may be shortened to reduce the operation pressure at rush hours.

Further, in order to ensure the driving safety, whether an obstacle is between the first and second trains may be judged. When there is an obstacle, the movement authority is calculated according to the third distance between the obstacle and the second train. Moreover, when the second distance of the first train is acquired, the running state of the first train is further considered, different movement authorities may be acquired according to different movement states, especially for a rapid deceleration state, and the second distance is set to zero to reduce the probability of collision between the first and second trains.

It should be noted that the executing entity of the method for acquiring a movement authority for a train according to the above embodiment may also be a zone controller (ZC). When the method for acquiring a movement authority for a train is executed by the ZC, traveling communication is no longer required between the first and second trains, and the preset safety margin needs to consider communication delay in the process of transmitting the calculated movement authority to the second train.

Figure 5:
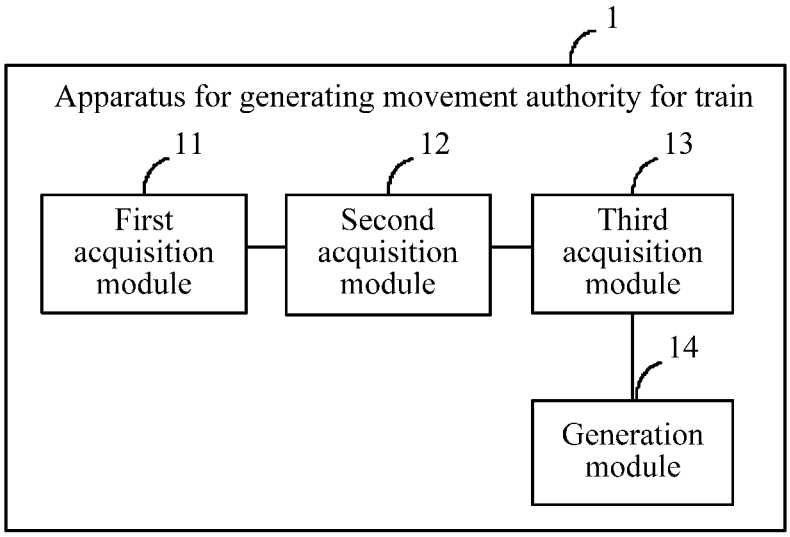
FIG. 5 is a structure diagram of an apparatus for generating a movement authority according to an embodiment of the present invention.

FIG. 5 is a structure diagram of an apparatus for generating a movement authority for a train according to an embodiment of the present invention. As shown in FIG. 5, the apparatus 1 for generating a movement authority for a train comprises a first acquisition module 11, a second acquisition module 12, a third acquisition module 13, and a generation module 14.

The first acquisition module 11 is configured to acquire a first distance between a first train and a second train; wherein the first train is in front of the second train and closest to the second train.

The second acquisition module 12 is configured to acquire, according to the speed information of the second train, a response time required by the second train for running across the first distance.

The third acquisition module 13 is configured to acquire, according to the speed information of the first train, a second distance across which the first train runs within the response time.

The generation module 14 is configured to generate a movement authority for the second train according to the first distance, the second distance and a preset safety margin.

Further, the generation module 14 is specifically configured to add the first distance to the second distance, and subtract the security margin from the added result to obtain the movement authority.

Further, the first acquisition module 11 is further configured to acquire location information of all trains in front of the second train, and determine the first train corresponding to the second train according to the location information.

Figure 6:
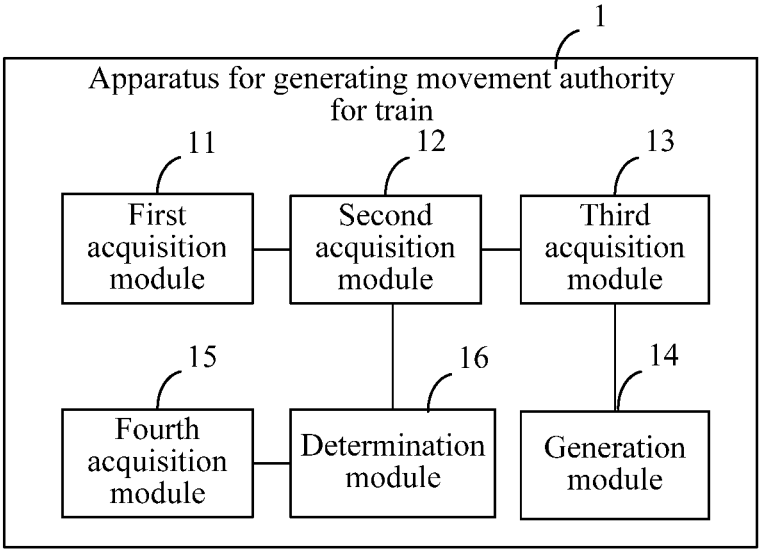
FIG. 6 is a structure diagram of a second acquisition module according to an embodiment of the present invention.

FIG. 6 is a structure diagram of an apparatus for generating a movement authority for a train according to an embodiment of the present invention. As shown in FIG. 6, the apparatus further comprises: a fourth acquisition module 15 and a determination module 16.

The fourth acquisition module 15 is configured to acquire an emergency braking distance of the second train.

The determination module 16 is configured to judge whether the first distance is smaller than the emergency braking distance.

The second acquisition module 12 is configured to acquire the response time according to the speed information of the second train when the determination module 16 judges that the first distance is smaller than the emergency braking distance.

Further, the generation module 14 is further configured to generate the movement authority for the second train according to the first distance and the safety margin when the determination module 16 judges that the first distance is equal to or greater than the emergency braking distance.

Figure 7:
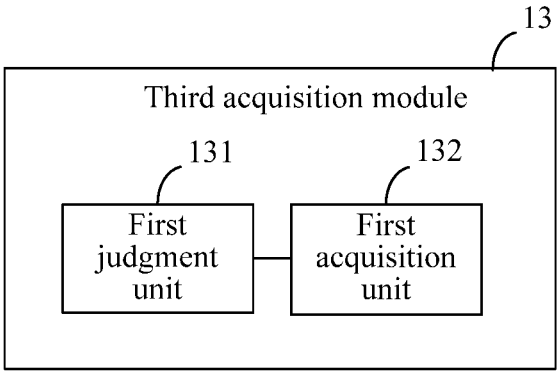
FIG. 7 is a structure diagram of a third acquisition module according to an embodiment of the present invention.

FIG. 7 is a structure diagram of the third acquisition module according to an embodiment of the present invention. As shown in FIG. 7, the third acquisition module 13 comprises: a first judgment unit 131 and a first acquisition unit 132.

The first judgment unit 131 is configured to judge, according to the speed information of the first train, whether the first train is in a deceleration state, and judge, if the first train is in a deceleration state, whether the deceleration of the first train is greater than a preset threshold;

The first acquisition unit 132 is configured to set the second distance to zero when the deceleration is equal to or greater than the threshold.

Further, the first acquisition unit 132 is also configured to acquire, when the deceleration is smaller than the threshold, the second distance according to the speed information and deceleration of the first train.

Figure 8:
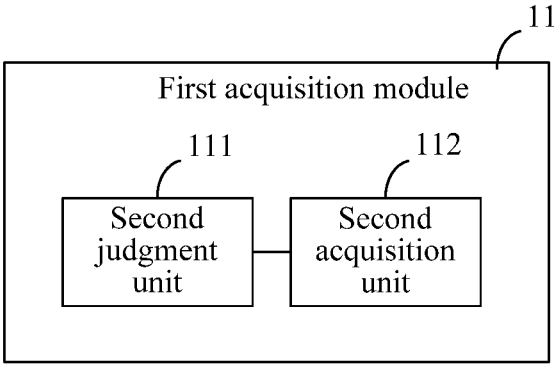
FIG. 8 is a structure diagram of a first acquisition module according to an embodiment of the present invention.

FIG. 8 is a structure diagram of the first acquisition module according to an embodiment of the present invention. As shown in FIG. 8, the first acquisition module 11 comprises: a second judgment unit 111 and a second acquisition unit 112.

The second judgment unit 111 is configured to judge whether an obstacle is between the first train and the second train.

The second acquisition unit 112 is configured to calculate, when there is no obstacle, a first distance between the first train and the second train according to the location information of the first train and the location information of the second train.

Further, the second acquisition unit 112 is further configured to calculate, when there is an obstacle, a third distance between the obstacle and the second train according to the location information of the obstacle and the location information of the second train.

The generation module 14 further generates a movement authority for the second train according to the third distance and the safety margin.

According to the apparatus for generating a movement authority for a train, provided by this embodiment, a first distance between a first train and a second train is acquired, a response time required by the second train for running across the first distance is acquired according to the speed information of the second train, a second distance across which the first train runs within the response time is acquired according to the speed information of the first train, and a movement authority for the second train is acquired according to the first distance, the second distance and a preset safety margin. In this embodiment, when the movement authority for the second train is calculated, the actual movement state of the first train is considered, and the first train is no longer set as a stationary obstacle, so that the movement authority is prolonged, the tracking distance may be shortened, the operation efficiency of a line is improved, and the dispatching interval may be shortened to reduce the operation pressure at rush hours.

Further, in order to ensure the driving safety, whether an obstacle is between the first and second trains may be judged. When there is an obstacle, the movement authority is calculated according to the third distance between the obstacle and the second train. Moreover, when the second distance of the first train is acquired, the running state of the first train is further considered, different movement authorities may be acquired according to different movement states, especially for a rapid deceleration state, and the second distance is set to zero to reduce the probability of collision between the first and second trains.

Figure 9:
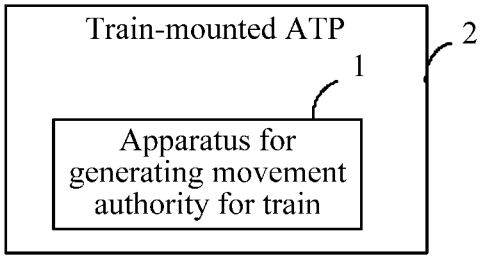
FIG. 9 is a structure diagram of a train-mounted ATP according to an embodiment of the present invention.

FIG. 9 is a structure diagram of a train-mounted ATP according to an embodiment of the present invention. As shown in FIG. 9, the train-mounted ATP 2 comprises the apparatus 1 for generating a movement authority for a train according to the above embodiment.

According to the train-mounted ATP provided by this embodiment, a first distance between a first train and a second train is acquired, a response time required by the second train for running across the first distance is acquired according to the speed information of the second train, a second distance across which the first train runs within the response time is acquired according to the speed information of the first train, and a movement authority for the second train is acquired according to the first distance, the second distance and a preset safety margin. In this embodiment, when the movement authority for the second train is calculated, the actual movement state of the first train is considered, and the first train is no longer set as a stationary obstacle, so that the movement authority is prolonged, the tracking distance may be shortened, the operation efficiency of a line is improved, and the dispatching interval may be shortened to reduce the operation pressure at rush hours.

Figure 10:
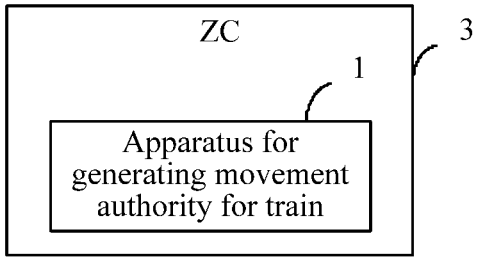
FIG. 10 is a structure diagram of a ZC according to an embodiment of the present invention.

FIG. 10 is a structure diagram of a ZC according to an embodiment of the present invention. As shown in FIG. 10, the ZC 3 comprises the apparatus 1 for generating a movement authority for a train according to the above embodiment.

According to the ZC provided by this embodiment, a first distance between a first train and a second train is acquired, a response time required by the second train for running across the first distance is acquired according to the speed information of the second train, a second distance across which the first train runs within the response time is acquired according to the speed information of the first train, and a movement authority for the second train is acquired according to the first distance, the second distance and a preset safety margin. In this embodiment, when the movement authority for the second train is calculated, the actual movement state of the first train is considered, and the first train is no longer set as a stationary obstacle, so that the movement authority is prolonged, the tracking distance may be shortened, the operation efficiency of a line is improved, and the dispatching interval may be shortened to reduce the operation pressure at rush hours.

It should be noted that in the description of the present invention, the terms such as "first" and "second" are used for the purpose of description only and are not to be construed as indicating or implying relative importance. In addition, in the description of the present invention, unless otherwise indicated, the meaning of "a plurality" is two or more.

Any process or method description in the flowchart or otherwise described herein may be construed as representing modules, segments, or portions of code comprising one or more executable instructions for implementing the steps of a particular logical function or process, and the scope of the preferred embodiments of the present invention comprises additional implementations. The functions may not be performed in the order shown or discussed. For example, the functions involved may be performed in a substantially simultaneous manner or in a reverse order. This should be understood by those skilled in the art to which the embodiments of the present invention pertain.

It is to be understood that portions of the present invention may be implemented through hardware, software, firmware, or a combination thereof. In the embodiments described above, various steps or methods may be implemented by software or firmware stored in a memory and executed by a suitable instruction execution system. For example, if implemented through hardware, as in another embodiment, the steps or methods may be implemented using any one or a combination of the following techniques known in the art: a discrete logic circuit having a logic gate for implementing a logic function on data signals, an application-specific integrated circuit having an appropriate combinational logic gate circuit, a programmable gate array (PGA), a field programmable gate array (FPGA), and the like.

A person of ordinary skill in the art may understand that all or some of the steps of the methods in the embodiments may be implemented by a program instructing relevant hardware. The program may be stored in a computer readable storage medium. When the program is executed, one or a combination of the steps of the method embodiments are performed.

In addition, functional units in the embodiments of the present invention may be integrated into one processing module, or each of the units may exist alone physically, or two or more units may be integrated into one module. The integrated module may be implemented in a form of hardware, or may be implemented in a form of a software functional module. When the integrated module is implemented in the form of a software functional module and sold or used as an independent product, the integrated module may be stored in a computer-readable storage medium.

The storage medium mentioned above may be a read-only memory, a magnetic disk, an optical disc, or the like.

In the description of the specification, the description made with reference to terms such as "one embodiment", "some embodiments", "example", "specific example", or "some examples" means that a specific characteristic, structure, material or feature described with reference to the embodiment or example is included in at least one embodiment or example of the present invention. In this specification, exemplary descriptions of the foregoing terms do not necessarily refer to a same embodiment or example. In addition, the described specific features, structures, materials, or characteristics may be combined in an appropriate manner in any one or a plurality of embodiments or examples.

Although the embodiments of the present invention are shown and described above, it can be understood that, the foregoing embodiments are exemplary, and cannot be construed as a limitation to the present invention. Within the scope of the present invention, a person of ordinary skill in the art may make changes, modifications, replacement, and variations to the foregoing embodiments.

What is claimed is:

1. A method for generating a movement authority for a train, comprising:

acquiring a first distance between a first train and a second train; wherein the first train is in front of the second train and closest to the second train;

acquiring, according to speed information of the second train, a response time required by the second train for running across the first distance;

acquiring, according to speed information of the first train, a second distance across which the first train runs within the response time; and generating a movement authority for the second train according to the first distance, the second distance, and a preset safety margin.

2. The method for generating a movement authority for a train according to claim 1, wherein the generating of a movement authority for the second train according to the first distance, the second distance, and a preset safety margin comprises:

adding the first distance to the second distance to obtain an added distance result; and subtracting the safety margin from the added distance result to obtain the movement authority.

3. The method for generating a movement authority for a train according to claim 1, wherein before acquiring a first distance between a first train and a second train, the method further comprises:

acquiring location information of all trains in front of the second train; and determining the first train corresponding to the second train according to the location information.

4. The method for generating a movement authority for a train according to claim 1, wherein before the step of acquiring, according to the speed information of the second train, a response time required by the second train for running across the first distance, the method further comprises:

acquiring an emergency braking distance of the second train;

determining whether the first distance is smaller than the emergency braking distance, and when the first distance is smaller than the emergency braking distance, acquiring the response time according to the speed information of the second train.

5. The method for generating a movement authority for a train according to claim 4, further comprising:

when the first distance is equal to or greater than the emergency braking distance, generating the movement authority for the second train according to the first distance and the safety margin.

6. The method for generating a movement authority for a train according to claim 1, wherein the acquiring, according to the speed information of the first train, of a second distance across which the first train runs within the response time comprises:

determining, according to the speed information of the first train, whether the first train is in a deceleration state;

when the first train is in a deceleration state, determining whether the deceleration of the first train is greater than a preset threshold; and when the deceleration is equal to or greater than the threshold, setting the second distance to zero.

7. The method for generating a movement authority for a train according to claim 6, further comprising:

when the deceleration is smaller than the threshold, acquiring the second distance according to the speed information and deceleration of the first train.

8. The method for generating a movement authority for a train according to claim 1, wherein the acquiring of a first distance between a first train and a second train comprises:

determining whether an obstacle is between the first train and the second train; and calculating, when there is no obstacle, a first distance between the first train and the second train according to the location information of the first train and the location information of the second train.

9. The method for generating a movement authority for a train according to claim 8. further comprising:

calculating, when there is an obstacle, a third distance between the obstacle and the second train according to the location information of the obstacle and the location information of the second train; and generating the movement authority for the second train according to the third distance and the safety margin.

10. An apparatus for generating a movement authority for a train, comprising:

a first acquisition module, configured to acquire a first distance between a first train and a second train; wherein the first train is in front of the second train and closest to the second train;

a second acquisition module, configured to acquire, according to speed information of the second train, a response time required by the second train for running across the first distance;

a third acquisition module, configured to acquire, according to speed information of the first train, a second distance across which the first train runs within the response time; and a generation module, configured to generate a movement authority for the second train according to the first distance, the second distance and a preset safety margin.

11. The apparatus for generating a movement authority for a train according to claim 10, wherein the generation module is specifically configured to add the first distance to the second distance to obtain an added distance result, and subtract the security margin from the added distance result to obtain the movement authority.

12. The apparatus for generating a movement authority for a train according, to claim 10, wherein the first acquisition module is further configured to acquire location information of all trains in front of the second train, and determine the first train corresponding to the second train according to the location information.

13. The apparatus for generating a movement authority for a train, according to claim 10, further comprising:

a fourth acquisition module, configured to acquire an emergency braking distance of the second train;

a determination module, configured to judge whether the first distance is smaller than the emergency braking distance; and wherein the second acquisition module is configured to acquire the response time according to the speed information of the second train when the determination module judges that the first distance is smaller than the emergency braking distance.

14. The apparatus for generating a movement authority for a train according to claim 13, wherein the generation module is further configured to generate the movement authority for the second train according to the first distance and the safety margin when the determination module judges that the first distance is equal to or greater than the emergency braking distance.

15. The apparatus for generating a movement authority for a train according to claim 10, wherein the third acquisition module comprises:

a first judgment unit, configured to judge, according to the speed information of the first train, whether the first train is in a deceleration state, and judge, when the first train is iia a deceleration state, whether the deceleration of the first train is greater than a preset threshold; and a first acquisition unit, configured to set the second distance to zero when the deceleration is equal to or greater than the threshold.

16. The apparatus for generating a movement authority for a train according to claim 15, wherein the first acquisition unit is further configured to acquire, when the deceleration is smaller than the threshold, the second distance according to the speed information and deceleration of the first train.

17. The apparatus for generating a movement authority for a train according to claim 10, wherein the first acquisition module comprises:

a second judgment unit, configured to judge whether an obstacle is between the first train and the second train; and a second acquisitionunit, configured to calculate, when there is no obstacle, a first distance between the first train and the second train according to the location information of the first train and the location information of the second train.

18. The apparatus for generating a movement authority for a train according to claim 17, wherein the second acquisition unit is further configured to calculate, when there is an obstacle, a third distance between the obstacle and the second train according to the location information of the obstacle and the location information of the second train; and the generation module further venerates the movement authority for the second train according to the third distance and the safety margin.

19. A train-mounted automatic train protection, comprising an apparatus for generating a movement authority for a train according to claim 10.

20. A zone controller, comprising an apparatus for generating a movement authority for a train according to claim 10.

* * * * *